US006823567B2

(12) United States Patent
Worrell et al.

(10) Patent No.: US 6,823,567 B2
(45) Date of Patent: Nov. 30, 2004

(54) PROCESS FOR PRODUCING SANDED ELASTIC FABRICS, AND FABRICS MADE THEREFROM

(75) Inventors: Richard Curtis Worrell, Moore, SC (US); Edmund L. Whiteman, Greenville, SC (US)

(73) Assignee: Milliken & Company, Spartanburg, SC (US)

( * ) Notice: Subject to any disclaimer, the term of this patent is extended or adjusted under 35 U.S.C. 154(b) by 168 days.

(21) Appl. No.: 10/339,980

(22) Filed: Jan. 10, 2003

(65) Prior Publication Data

US 2003/0104744 A1 Jun. 5, 2003

Related U.S. Application Data

(62) Division of application No. 09/495,257, filed on Jan. 31, 2000.

(51) Int. Cl.[7] ..... D06C 11/00
(52) U.S. Cl. ..... 26/31; 26/30; 26/31; 451/28
(58) Field of Search ..... 26/29 R, 30, 31, 26/32, 33, 34, 35, 36, 37, 29 P; 451/1, 28, 415, 416, 442; 428/91; 442/304, 306, 314

(56) References Cited

U.S. PATENT DOCUMENTS

| | | | | |
|---|---|---|---|---|
| T962,002 | I4 | | 9/1977 | Moore et al. |
| 4,607,409 | A | | 8/1986 | Hishimuma et al. |
| 4,951,366 | A | | 8/1990 | Geller |
| 5,080,952 | A | | 1/1992 | Willbanks |
| 5,205,140 | A | | 4/1993 | Nielsen et al. |
| 5,352,518 | A | | 10/1994 | Muramoto et al. |
| 5,547,733 | A | | 8/1996 | Rock et al. |
| 5,875,419 | A | | 2/1999 | Nevel et al. |
| 6,112,381 | A | * | 9/2000 | Dischler et al. ..... 26/28 |

* cited by examiner

*Primary Examiner*—Cheryl A. Juska
*Assistant Examiner*—Lynda M Salvatore
(74) *Attorney, Agent, or Firm*—Terry T. Moyer; Sara M. Current

(57) ABSTRACT

A process for making sanded elastic fabrics having low fuzz is described. The process involves sanding an elastic fabric with a microfinishing film to achieve a fabric having good side-center-side consistency, and a thick, consistent nap produced from a large number of short hairs. The fabrics can be produced at greater efficiency than achieved from conventional sanding methods, and with an enhanced aesthetic appearance.

6 Claims, 3 Drawing Sheets

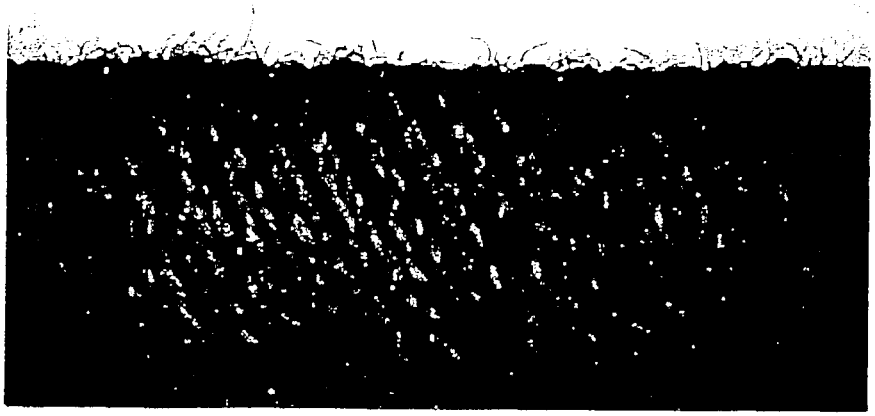
FIG. –1A–
PRIOR ART
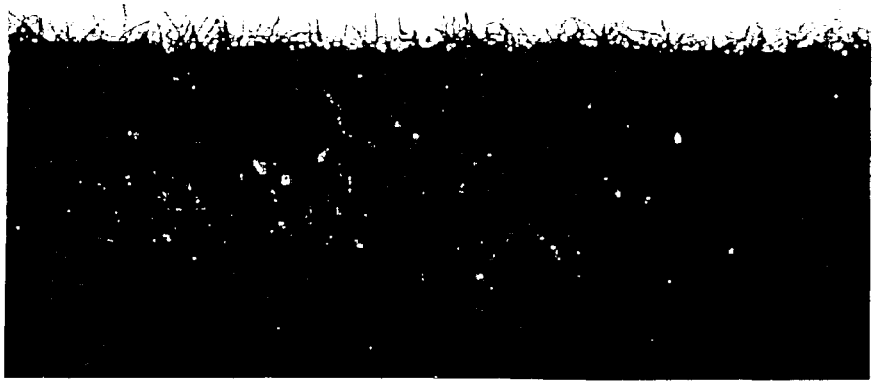
FIG. –1B–
PRIOR ART

PROCESS FOR PRODUCING SANDED ELASTIC FABRICS, AND FABRICS MADE THEREFROM

This Application is a Divisional of prior copending parent application Ser. No. 09/495,257, filed on Jan. 31, 2000.

FIELD OF THE INVENTION

The invention generally relates to a process for producing sanded elastic fabrics, and sanded elastic fabrics having improved aesthetic characteristics. More specifically, the invention relates to a process for producing sanded elastic fabrics at increased levels of quality and levels of efficiency, and sanded, elastic fabrics having good hand, low fuzz level, and consistent nap density and height across the width of the fabric.

BACKGROUND OF THE INVENTION

Knit fabrics are commonly used in a variety of end uses, such as industrial products, apparel and the like. One advantage associated with knit fabrics is that they can be constructed to have good stretch characteristics. Such characteristics of a knit fabric can be enhanced through the use of elastic fibers in the fabric. For example, elastic fibers such as spandex are now often included in knit fabrics to provide the fabrics with a high degree of stretch. These fabrics are particularly desirable in the manufacture of intimate apparel items, bathing suits and the like since they allow the manufacturer to vary the amount of compression and support which the garments will provide.

When using fabrics in end uses such as apparel, it is often desired to treat the fabric in some way to improve its hand. For example, fabrics are often treated mechanically, such as by sanding or otherwise abrading the fibers on the surface of the fabric to provide the surface with a softer feel. Such face finishing processes can be performed on one or both surfaces.

Conventional sanding processes for textile fabrics are commonly performed by contacting one or both fabric surfaces with a roller which has been covered with sandpaper. While performing well in some applications, this method can be difficult to use on elastic fabrics, and in particular, on elastic knit fabrics. (As used herein, the term "elastic fabrics" is meant to describe those fabrics containing elastic fibers, and the term "elastic knit fabrics" is intended to describe knit fabrics incorporating elastic fibers, regardless of the manner in which they are knit.) For one, the sandpaper has a tendency to become loaded up with abraded fiber material very quickly, which requires that the paper be removed and new sandpaper applied. For example, the sandpaper on a roll used to process elastic fiber-containing knit fabrics can typically only process about 5,000 yards of fabric before it becomes so loaded with particles from the fabric that it must be replaced.

In addition, it can be difficult to impossible to achieve a consistent nap across the width of the fabric (i.e., the direction perpendicular to that of fabric travel during processing), which leads to what is referred to as a high degree of side-center-side variation. As can be readily appreciated by those of ordinary skill in the art, fabrics which are inconsistent are generally undesirable for many end uses as they do not provide a consistent appearance or consistent performance. This is a particular problem for elastic knit fabrics, as they have a tendency to neck down in the center during the face finishing operation, resulting in the selvages of the fabric being sanded more than the center of the fabric. Consequently, the center of the fabric can tend to look pitted, which is undesirable from a fabric quality perspective.

Even more importantly, knit fabric manufacturers have heretofore been unable to produce sanded elastic fabrics which do not have a high amount of fuzz on the fabric surface. Such fuzz (which is a result of fiber breakage, can be unappealing from an aesthetic perspective, and can encourage pilling of the fabrics during use. In an attempt to minimize the fuzzing effect to the extent possible, manufacturers typically are forced to sand the sandpaper itself prior to using it on the elastic knit fabrics in order to remove the sharp points on the sandpaper grit. Even with the inclusion of this additional processing step (which in turn adds cost to the manufacturing operation), the amount of fuzzing achieved is still greater than what would be desired.

SUMMARY

The instant invention enables the manufacture of a sanded elastic fabric which has a good feel and which does not have an undesirable fuzzy appearance. In addition, the instant invention achieves fabrics having good side-center-side consistency, both in terms of nap density and nap height. Furthermore, the process of the invention enables the production of higher quality sanded elastic fabrics at increased levels of efficiency.

The process of the invention involves the use of a microfinishing film on the roller of a conventional sanding or sueding machine. To the knowledge of the inventors, such films have not previously been used to process textile fabrics, rather they have been used to sand metal parts, solid surface composites, fiberglass, paints and plastics. The fabric is then sanded with the microfinishing film, which functions to loosen the fibers in the yarn bundles without undesirably cutting them in the manner of conventional sandpaper.

It has been found that microfinishing films do not load up as readily as conventional sandpaper, such that a significantly greater quantity of fabric can be processed before replacement of the film is required. For example, it has been found that 20,000 yards of a fabric can be processed by the microfinishing film whereas only 5,000 yards of the same fabric could be processed with conventional sandpaper before replacement of the sanding medium was required.

DETAILED DESCRIPTION

Figure 1C:
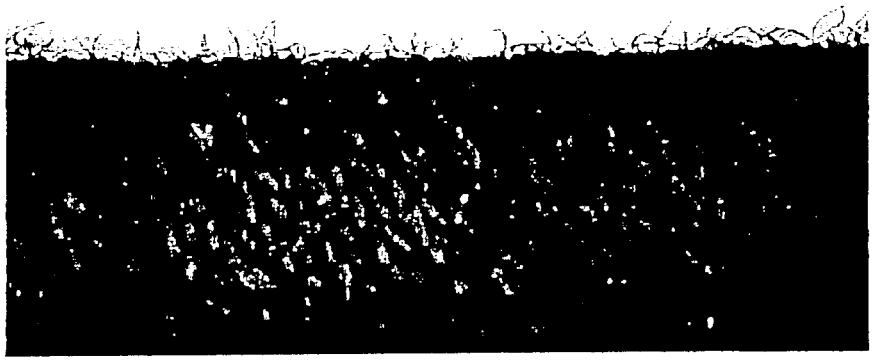
FIG. -1C- PRIOR ART
FIGS. 1*a, b* and *c* are side views of a piece of fabric sanded according to a conventional process, with FIG. 1*a* being taken from the left side of the fabric, FIG. 1*b* being taken from the center of the fabric, and FIG. 1*c* being taken from the right side of the fabric.

In the following detailed description of the invention, specific preferred embodiments of the invention are described to enable a full and complete understanding of the invention. It will be recognized that it is not intended to limit the invention to the particular preferred embodiment described, and although specific terms are employed in describing the invention, such terms are used in a descriptive sense for the purpose of illustration and not for the purpose of limitation.

The fabrics of the instant invention are fabricated in a conventional manner to include elastic fibers so as to provide an elastic fabric. In particular, the fabrics are desirably knit fabrics, either of the warp or weft knit variety. Particularly preferred are warp knit fabrics of the tricot knit or raschel knit variety.

The fabric content can be selected by the manufacturer to achieve the desired end properties, and preferably includes a blend of fibers such as a blend of elastic fibers and non-elastic fibers. For example, the fabrics can be knit from polyester and spandex, nylon and spandex, cotton and spandex or any other type of yarn combination which achieves the desired performance properties. Where a blend of fibers is utilized, the proportion of the respective fiber inputs can likewise be chosen by the manufacturer to achieve the desired end properties. In a preferred form of the invention particularly useful in the manufacture of fabrics for use in the apparel market, the fabric includes from about 5% to about 95% elastic fiber, and more preferably about 20% to about 80% elastic fiber. Spandex fibers have been found to perform well in fabrics processed according to the invention, and are particularly preferred for use as the elastic fiber component in fabrics of the invention. However, other elastic fibers can be used within the scope of the invention.

The fabrics of the invention have a shorter, denser, and more consistent nap than those produced by conventional sanding methods. The fiber separation from the fiber bundles is less in the fabrics processed according to the instant invention as opposed to those sanded according to conventional methods. As a result, the fabrics have an appearance similar to that of substantially unsanded fabrics (and do not have an undesirable fuzzy appearance) while having the soft feel associated with sanded fabrics.

Because the fabrics of the invention do not have the random long nap fibers that the conventionally-sanded fabrics have, the nap is much more consistent across the fabric surface. Furthermore, the center of the fabric does not neck down during processing like with the prior art processes. As a result, the appearance of greater side-center-side consistency can be achieved. In addition, because of the short, dense nap and the greater nap consistency, the fabrics do not have the undesirably fuzzy appearance of the conventional sanded elastic fabrics.

The process of the invention involves sanding an elastic fabric, and preferably a knit elastic fabric, in a manner which achieves a unique product at good levels of efficiency and consistency. As noted above, the fabric is sanded using a microfinishing film. Preferably, the microfinishing film is provided in the form of a long strip which is helically wrapped around the roller(s) of a conventional sanding or sueding machine. The microfinishing film is desirably of the variety in which precision micron-graded aluminum oxide mineral is resin-bonded to a polyester film backing, although other forms of microfinishing film could be used within the scope of the invention.

The grade of film used can be selected according to the type of fabric construction being processed, the fiber content of the fabric, and the amount of sanding which is desired. For example, 10 to 40 micron films have been found to perform well, and it has been found that a 30 micron film works well on lightweight raschel knit fabrics of polyester and spandex while a 20 micron film works well on lightweight tricot knit fabrics of polyester and spandex. In addition, the film can be used on a single roller of a sanding machine, or on a plurality of rollers. Furthermore, it is contemplated that the film can be used to contact the fabric in other forms than the roller, such as flat sanding.

It has been found that the microfinishing film overcomes many of the problems associated with loading of the sandpaper, and in fact can process approximately four times as much fabric as conventional sandpaper. Although not yet proven, the inventors suspect that the resin on the film serves to repel the charge of particles from the fabric, thereby reducing its tendency to become loaded with particulate from the fabric.

The fabric can be dyed as desired, and has been found to retain a good hand despite the use of fixes with the dye. Furthermore, it has been found that the fabric maintains good colorfastness after dyeing.

EXAMPLES

A fabric was tricot knit from 58 denier yarns made from 60 filaments of micromatique polyester and 40 filaments of spandex for an overall fiber content of 86% polyester and 14% spandex. The fabric had a weight of approximately 7.4 oz/sq yard.

A first portion of the fabric produced was sanded according to a conventional process at 50% sanding roller speed using a single roll on the machine. The fabric was subsequently jet dyed black in a conventional manner.

A second portion of the fabric produced was sanded according to the instant invention. More specifically, the fabric was processed using a 20 micron microfinishing film on two rolls operated at 100% machine speed. The fabric was then jet dyed white in a conventional manner.

Photomicrographic enlargements of the respective fabrics were made to illustrate the differences in the hairiness and fuzz of the respective fabric surfaces. FIGS. 1*a,* 1*b* and 1*c* are photomicrographs taken of a side view of the fabric sanded according to conventional methods, while FIGS. 2*a,* 2*b* and 2*c* are side views of a fabric produced according to the instant invention.

As illustrated, the fabric which was sanded using conventional sanding methods had greater variation in fabric nap across the width of the fabric, as evidenced in the difference in nap appearance between FIGS. 1*a,* 1*b,* and 1*c,* as FIG. 1*a* is taken from the left side of the fabric, FIG. 1*b* is taken from the center of the fabric, and FIG. 1*c* is taken from the right side of the fabric. In addition, the photomicrographs illustrate that the fabric sanded according to conventional methods had a smaller number of nap hairs than that of the fabric of the invention, while having a much broader range of nap hair lengths and a longer overall nap. As a result, the fabric produced by this method had an overall fuzzy appearance.

Figure 2A:
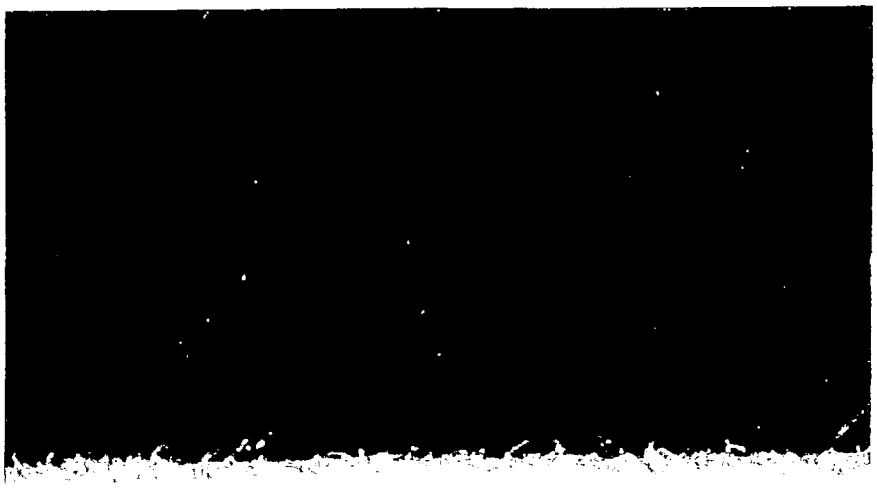
FIGS. 2*a,* 2*b* and 2*c* are side views of a piece of fabric of the same variety shown in FIG. 1, but which has been processed according to the instant invention, with FIG. 2*a* being taken from the left side of the fabric, FIG. 2*b* being taken from the center of the fabric, and FIG. 2*c* being taken from the right side of the fabric.
Figure 2B:
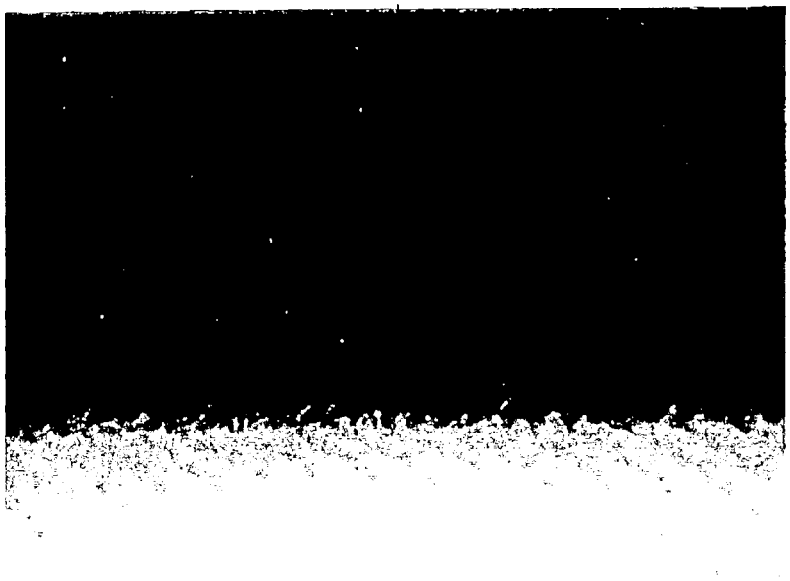
Figure 2C:
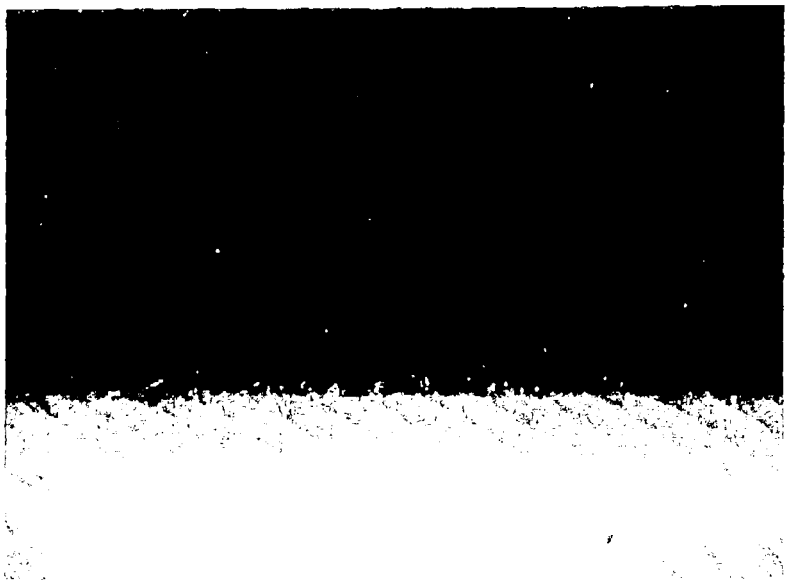

In contrast, the fabric made according to the instant invention had a larger number of shorter hairs which were provided at a more consistent level across the dimension of the fabric. More specifically, FIG. 2*a* illustrates a portion of the left side of the fabric, FIG. 2*b* illustrates a portion of the center of the fabric, and FIG. 2*c* illustrates a portion of the center of the fabric. As illustrated, the fabric included a greater number of nap hairs than in the prior art fabric, the nap hairs were more consistently distributed across the width of the surface of the fabric, and the hairs were shorter and more consistent in length than those of the prior art fabric. Yarn fiber breakage was therefore minimized, while still obtaining good loosening of the yarn filament bundles in order to obtain a good fabric hand.

The fabric samples were then tested for hairiness on a Zweigle T690 Hairiness Tester in accordance with the manufacturer's instructions. This test records all random fibers which extend outwardly from the plane of the fabric, records them graphically, and calculates the integration of the area beneath the curve plotted on the graph. Each sample was tested twice, and the averages calculated for each. The results are listed in Table I below:

TABLE I

| | Conventional Sanded | Microfinishing Film Sanded |
|---|---|---|
| Left side | 0.14 | 0.07 |
| Center | 0.155 | 0.0325 |
| Right Side | 0.125 | 0.0375 |

As illustrated in the table, the fabric made according to the instant invention achieved more consistent nap hairiness across the fabric width, as evidenced by the lower numbers achieved from the hairiness tests. In addition, as evident from the photomicrographs, the fabric of the instant invention had a greater number of consistently sized, shorter hairs. Furthermore, it was found that the fabric of the invention passes IIA Wash Fastness tests. Also, the center of the fabric of the invention did not have a longer nap than the sides of the fabric, which suggests that the fabric was not experiencing the necking problems experienced by the prior art sanding methods.

Surprisingly, it has also been found that the microfinishing films can be used to achieve fabrics at a greater level of efficiency than achievable with the prior art sandpaper, as the film does not have the tendency to load up with material from the fabric in the manner of sandpaper. Therefore, whereas a conventional sandpaper roller would typically be expected to process only about 5,000 yards of an elastic knit fabric before having to be replaced, a roll covered with a microfinishing film in the manner of the invention has been found to be capable of processing 20,000 yards of fabric while maintaining consistent good results.

In the specification there has been set forth a preferred embodiment of the invention, and although specific terms are employed, they are used in a generic and descriptive sense only and not for purpose of limitation, the scope of the invention being defined in the claims.

We claim:

1. A process for improving the hand of elastic fabrics comprising the steps of:

contacting a surface of an elastic fabric with a microfinishing film to abrade the fibers on at least one surface of the fabric.

2. A process according to claim 1, wherein said elastic fabric comprises an elastic knit fabric.

3. A process according to claim 2, wherein said elastic fabric comprises a warp knit fabric.

4. A process according to claim 1, wherein said step of contacting comprises contacting the surface of the elastic knit fabric with at least one roller having at least a portion of its surface covered with a microfinishing film.

5. A process according to claim 1, wherein said step of contacting comprises contacting the surface of the elastic fabric with a microfinishing film having a grade of between about 10 and about 40 microns.

6. A process according to claim 1, wherein said elastic fabric comprises spandex fibers.

* * * * *